US005820522A

United States Patent [19]

Smallwood et al.

[11] Patent Number: 5,820,522

[45] Date of Patent: Oct. 13, 1998

[54] ORTHOPAEDIC GRIPPING DEVICE

[75] Inventors: Paul A. Smallwood; Michael G. Eckman, both of Chesterfield, Mo.

[73] Assignee: Taylor-Nathan Co., Inc., St. Louis, Mo.

[21] Appl. No.: 847,331

[22] Filed: Apr. 23, 1997

[51] Int. Cl.[6] ..... A63B 23/16

[52] U.S. Cl. ..... 482/49; 482/47

[58] Field of Search ..... 482/44, 47, 49

[56] References Cited

U.S. PATENT DOCUMENTS

| | | | |
|---|---|---|---|
| 27,934 | 1/1905 | Wolffe . | |
| D. 226,736 | 4/1973 | Benis . | |
| 2,108,236 | 2/1938 | Scott . | |
| 2,271,164 | 1/1942 | Sullivan . | |
| 2,461,695 | 2/1949 | McMahon . | |
| 3,129,939 | 4/1964 | Stock . | |
| 3,542,363 | 11/1970 | Bishop . | |
| 3,606,316 | 5/1969 | Krewer . | |
| 3,612,521 | 10/1971 | Wendeborn . | |
| 4,323,232 | 4/1982 | Terpening . | |
| 4,730,827 | 3/1988 | Williams . | |
| 4,840,370 | 6/1989 | Biddlecombe | 482/49 |
| 5,190,504 | 3/1993 | Scatterday | 482/49 |

OTHER PUBLICATIONS

The Solution: Sorbothane brochure, Jun. 1992.

Wilson Power Squeez Flyer; Fastrac Communications; 1994.

Cones and Positioners; "Protect Patient's Palm From Nail Injury"; Catalog pp. W33–W34; AliMed, Inc., 1996.

"The Shape That Fits Your Sport"—Dunlop Eggsportz; Eggstra Enterprises, Inc. Flyer, 1996.

"12 Hand Exercises Power Putty"; SportsHealth Flyer, 1996.

*Primary Examiner*—Lynne A. Reichard

*Attorney, Agent, or Firm*—Blackwell Sanders Peper Martin

[57] ABSTRACT

An orthopedic gripping device permits therapeutic treatment of the user's hand. The device comprises a generally oblong body having a circular transverse section, the body having a first end and a second end and extending continuously in a smooth curve between the two ends. A plurality of flat extensions are integrally formed on and extend outwardly from the body, spacedly from and parallel in relation to each other. The device is placed in the user's hand with the plurality of extensions protruding outwardly between the user's fingers and the body portion of the device is held cradle in the palm of the user's hand and a preselected portion of the user's hand is moved in relation to the device in order to therapeutically treat a particular predetermined finger or other portion of the hand.

24 Claims, 5 Drawing Sheets

ORTHOPAEDIC GRIPPING DEVICE

BACKGROUND AND SUMMARY OF THE INVENTION

The present invention relates, generally, to therapeutic gripping devices, and more particularly, to an orthopaedic gripping device which is designed for physical therapy related exercises to strengthen and otherwise treat specific hand structure in a method that is both isotonic and isometric.

There are many preexisting orthopaedic devices for providing therapeutic hand exercises. Many of the known devices are simply ball-shaped or egg-shaped rubber or other soft, pliable material for continuous squeezing to increase the gripping strength of the user's hand in a general, non-specific manner. None of the known devices are designed as disclosed hereafter, nor does any one such known device permit the user to perform the multiple functions which can be attained with the present orthopaedic device.

The present orthopaedic grip is a generally oblong-shaped device, with the diameter of one end being smaller than the diameter of the other end, and with three flat integral extensions or extrusions which protrude from one side of the body of the grip, in longitudinal alignment, one above another, for placement between the fingers of the user. The function of these extensions will be shown hereafter to be important to the therapeutic use of the new orthopaedic grip.

Although there is no unreasonable limit on the overall size of the device, for children, the device may be provided in a smaller overall size than described above, for optimal therapeutic use and results. Provision of the therapeutic gripping device in varying degrees of firmness is foreseen, in order to permit the user to gradually increase resistance of the therapeutic device as strength builds over the course of therapy.

The new therapeutic gripping device for upper extremity strengthening permits both isometric and isotonic strengthening of the hand and forearm muscles. It is to be understood that throughout this document "isometric" is intended to refer to muscle action which occurs against resistance and "isotonic" is intended to refer to the contraction of a muscle under constant pressure. These definitions are the usual and conventional ones used in the art of physical therapy. The finger extrusions of the structural design allow strengthening of individual muscles in the hand and forearm and produce isolated gliding of the tendons that are attached to each finger.

The material used to form the new device by molding permits selective heating or cooling of the gripping device to improve range of motion, while decreasing inflammation in the hand. Specifically, the gripping device can be heated at the beginning of physical therapy, increasing blood flow to the hand and improving muscle tendon and joint motion. Thereafter, the gripping device can be cooled, for example, near the end of therapy, in order to decrease the swelling which typically occurs in an injured hand with exercise.

When combined with a strengthening and stretching program as disclosed hereafter, upper extremity cumulative trauma disorders can be prevented and/or treated if already present. Such exercises include both isometric and isotonic exercises to treat these disorders. Medical experience with the device in a clinical therapy setting with hand surgery patients indicates noted improvement in compliance with exercises by the patient, as well as in the results previously mentioned, due to the comfort of the device during use, which comfort is attributed in part to the material used, and especially to the shape, which is designed specifically for user comfort, with a smooth outer surface and configuration of the curves and extrusions which readily suit the normal shape of the human hand.

Accordingly, it is among the many objects of the present invention to provide a therapeutic gripping device which permits the user to exercise specifically isolated hand muscles and tendons in a number of ways, depending on the specific exercise method chosen by the user and to further permit the user to obtain both isotonic and isometric therapeutic advantages.

It is further among the objects of the present invention having the features indicated that the device be capable of being sized and shaped for use by substantially any individual and that it be capable of being made available in substances of preselected, varied firmness for permitting increased resistance as the therapy proceeds and the user (patient) becomes stronger.

It is further among the objects of the present invention having the features indicated that the new orthopaedic gripping device be formed of a material which is suitable for both selective heating and cooling, in order to further enhance the therapeutic options available to the medical professional and increase the potential beneficial therapeutic results available to the user.

Accordingly, in furtherance of the above objects, the present invention is, briefly, an orthopedic gripping device which permits therapeutic treatment of the user's hand. The device comprises a generally oblong body having a circular cross section, the body having a first end and a second end and extending continuously there between. A plurality of flat extensions intersect and extend outwardly from the body, spacedly from one another and parallel in relation to each other.

The invention also is, briefly, a method of therapeutically treating a user's hand wherein the method includes providing a device having a generally oblong body with a circular transverse section, the body having a first end and a second end and extending continuously in a smooth curve between the first end and the second end, and a plurality of extensions which extend outwardly from the body, spacedly and parallel in relation to each other. The device is placed in the user's hand with the plurality of extensions protruding outwardly between the user's fingers and the body portion of the device is held cradle in the palm of the user's hand and a preselected portion of the user's hand is moved in relation to the device in order to therapeutically treat a particular predetermined finger or other portion of the hand.

These and other objects will become apparent and, in part, pointed out hereinbelow.

BRIEF DESCRIPTION OF THE DRAWINGS

Throughout the drawings, like parts will be indicated by like element numbers.

DESCRIPTION OF THE PREFERRED EMBODIMENT

Figure 1:
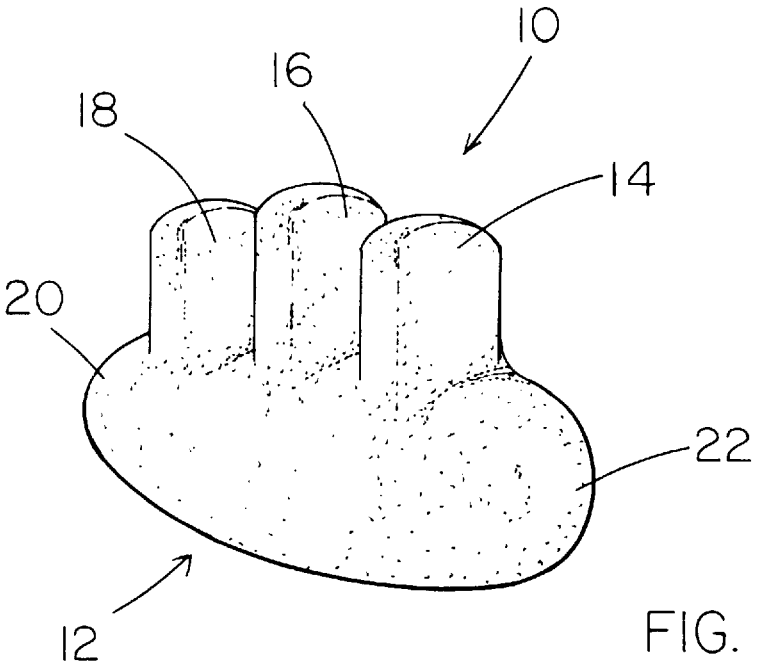
FIG. 1 is a perspective view of an orthopaedic gripping device constructed in accordance with and embodying the present invention.

Throughout the drawings, 10 generally designates an orthopaedic gripping device constructed in accordance with and embodying the present invention. Gripping device 10 preferably has an overall smooth surface for user comfort, and is composed of a generally oblong body portion 12 which is firm but not inflexibly rigid. Body 12 has a substantially circular transverse section and three extensions or extrusions 14, 16 and 18 (described in detail hereafter) moldably formed integrally thereon as part of the unitary, one-piece structure of device 10.

Orthopaedic grip 10 is appropriately sized and shaped for comfortable holding in the human hand, and is approximately 3½ to about 4½ inches in overall length (and preferably 3¾ inches) with elongated body portion 12 decreasing in diameter as it passes from the longitudinal middle toward each smoothly curved or rounded-off end, with the diameter of one end being relatively smaller than the diameter of the other end. The diameter at the largest point along the length of body 12 is approximately 1½ inches to about 2½ inches and is preferably about 2 inches.

Figure 2:
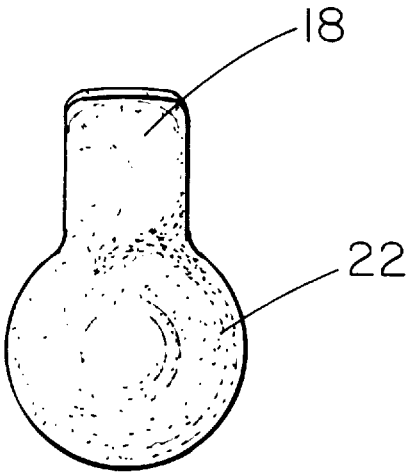
FIG. 2 is an end elevational view of the device of FIG. 1, taken from the end shown at the left in FIG. 1.
Figure 3:
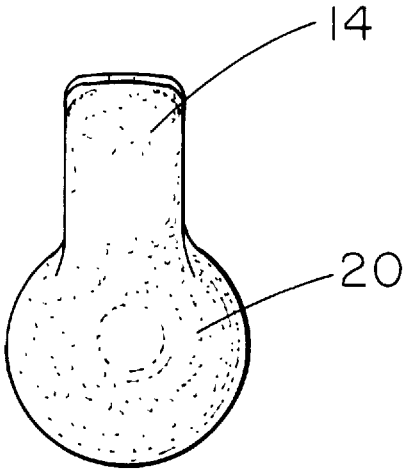
FIG. 3 is an end elevational view of the device of FIG. 1, taken from the end shown at the right in FIG. 1.
Figure 4:
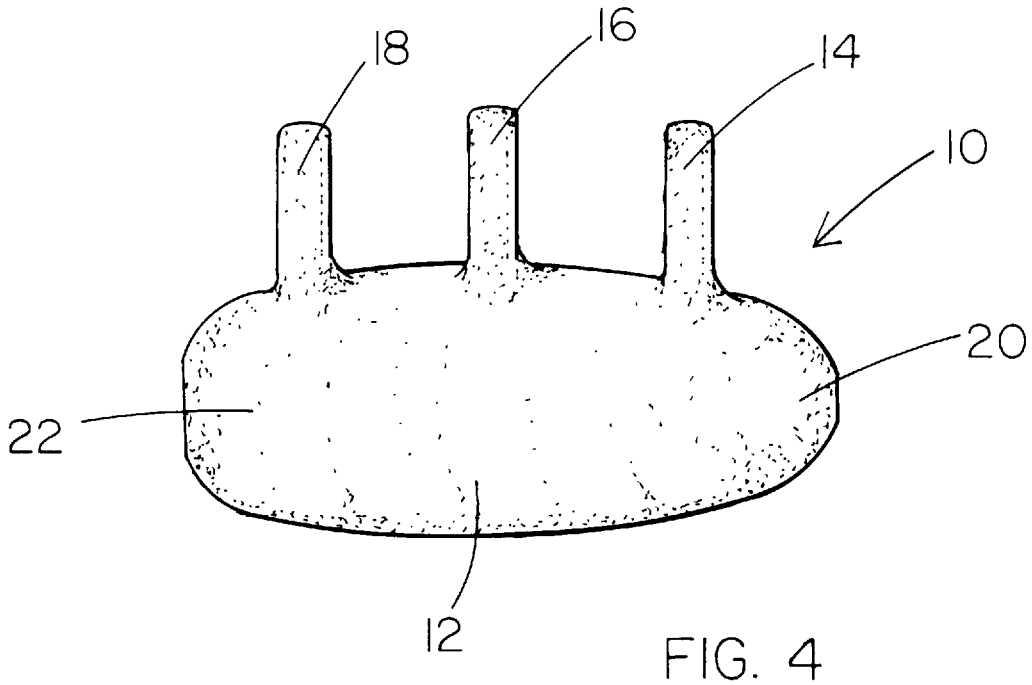
FIG. 4 is a side elevational view of the device of FIG. 1, showing the side opposite that shown in the FIG. 1, the opposite side being a mirror image.
Figure 5:
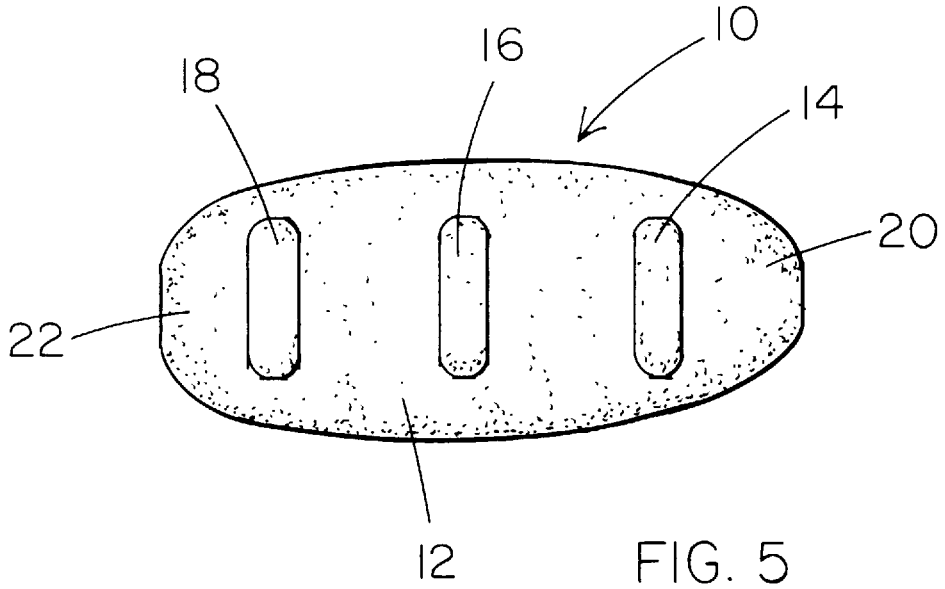
FIG. 5 is a side elevational view of the device of FIG. 1, showing the ends of the finger extrusions formed integrally on one side of the body of the device.
Figure 6:
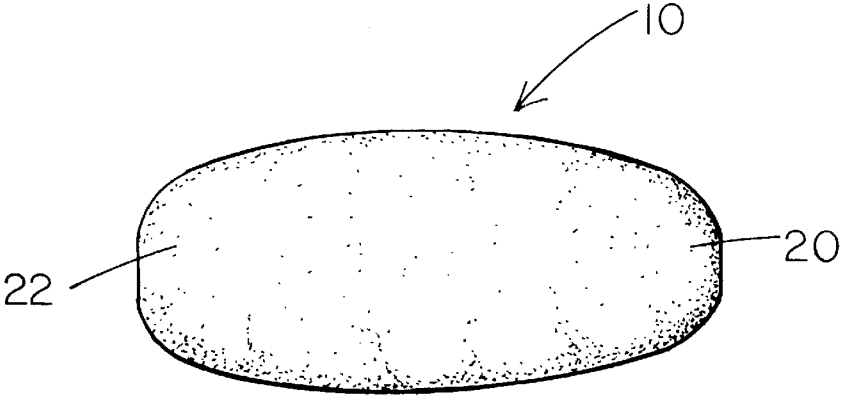
FIG. 6 is a side elevational view of the device shown in FIG. 1, showing the side directly opposite the position of the finger extrusions shown in FIG. 5.

Body portion 12 extends continuously between the two opposed ends thereof. End 20, which is shown at the left of FIG. 1, is narrower than the opposite end 22. End 20 is also shown in FIG. 3, and at the right of FIGS. 4–6. Relatively wider end 22 is shown at the right in FIG. 1, in FIG. 2, and at the left in FIGS. 4–6.

As shown for example in FIG. 1, finger extensions 14, 16, 18 are generally flat structures, preferably, although not necessarily identical to each other, which extend radially outwardly from the smooth outer side wall of body 12, in alignment, longitudinally in relation to one another, and each in a plane transverse to the longitudinal axis of body 12, substantially parallel to the plane of each other extension.

Each extension 14, 16, 18 has a thickness of approximately ¼ inch, a length from the point of intersection of body 12 radially outwardly approximately ¾ inch to about 1½ inch (preferably 1⅛ inch), and a transverse dimension (width) of approximately ⅝ inch to about 1½ inch (preferably 1¼ inch). Each of the extensions 14, 16 and 18 is positioned on device 10 with the planar, flat surfaces thereof disposed transversely on body 12, with extension 16 being positioned as shown between 14 and 18, spaced approximately equidistant and sufficiently far apart from one another to receive between any two adjacent extensions one of the user's fingers.

Preferably extensions 14, 18, the end-most extensions, are positioned inwardly from the respective ends of body 12 by about ⅝ inch, although it is conceivable that body 12 could extend beyond the end-most extensions 14, 18 slightly more or less than the preferred amount. Gently curved distal end surfaces of each extension 14, 16, 18 protrude away from body 12 and, during some forms of use extend between the user's fingers.

During some of the recommended therapeutic uses described hereafter device 10 is gripped in the user's palm, with the narrower end 20 between the user's thumb and forefinger and the wider end 22 gripped by the little finger or smallest finger F4 of the hand against the palm. This is the case whether the device is being used in either of the right or left hands, for many of the methods described below, such as the therapeutic methods shown in FIGS. 7A and 7B, 8A, 8B, 8C, 11, 12 and 13A, 13B and 13C. Also during such uses, extensions 14, 16 and 18 are positioned between the user's fingers as illustrated for example in FIG. 11, discussed hereafter with reference to the fifth method of use.

Figure 14:
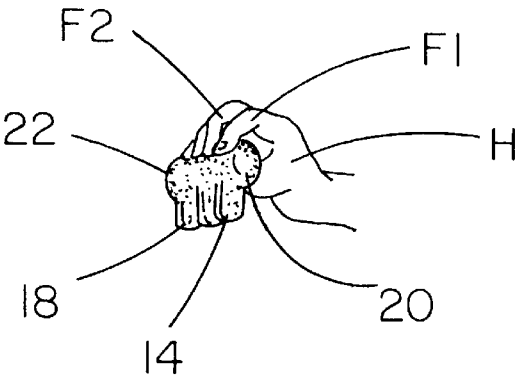
FIG. 14 illustrates an eighth method of use of the device of FIG. 1, the method being referred to herein as the "fingertip pinch".

FIG. 14 and the description of the eighth method described herein show an example of one alternative position for use of device 10. Other alternative positions and methods will also be described.

Further with regard to its structure, device 10 is preferably formed as a unitary molded piece of a compressible urethane polymer material presently marketed under the name SORBOTHANE (SORBOTHANE is a registered trademark of Sorbothane, Inc.), or other similar urethane or other polymeric material which is suitable for cooling or heating to permit therapeutic temperature changes during performance of the methods described hereafter. When device 10 is formed of the material described the firmness may be varied between given devices so that an injured person can initially be provided with a softer device 10, and, as the injured hand or arm improves, a second or third level of firmness may be provided. Also when made of the preferred material, or with other conceivable equivalents, device 10 can be easily washed for optimal sanitary use in a therapeutic facility by multiple patients, and it can be provided in virtually any color desired so as to permit color coding of the various firmness levels of the material for convenience of the therapist or patient user.

Ideally, the firmness of the device 10 will be in a range from approximately 25 to approximately 65 durameters on a 00 scale. However, it is foreseen that it will be offered in various levels, for example, 30, 45 and 60 durameters, each of these proposed levels potentially varying by about plus or minus 5 units. It is further expected that the different levels of firmness will be color coded for simplicity and ease of use in a therapeutic setting. For example, red may be the softest or least firm device 10, with a durameter reading of 30, and green may be the firmest, with a hardness reading of 60 durameters. Blue, or some other color may be chosen as the medium level (for example, 45 durameters). Of course a different color scheme may be chosen if preferred.

Among the general advantages of device 10 are the thermal capacity feature which is important because with the preferred substance described, or an equivalent thereof, the preselected warm or cool temperature can be retained by the material during use for an extended period of time. This is a known quality of commercially available urethane materials, such as that sold under the registered trademark SORBOTHANE, and other similar, available materials, but such quality is particularly of use with device 10, because, due to the finger extensions 14, 16 and 18, the therapeutic temperature selected is more effectively transmitted to the portions of the hand being exercised.

The new device 10 is primarily a hand strengthener, by its unique design this device permits treatment or exercise of many more muscle and tendon groups than other known and simpler devices. Although there are some hand strengtheners available which are used in therapy and by athletes and the general public, the present orthopaedic gripping device 10 is differentiated by providing isometric, isotonic and specific muscle isolation and tendon action and strengthening. The isometric and isotonic principles of the use of the device give it the multiple use utility which is unique relative to other known gripping devices.

Further advantages of the structural features of device 10 are that extensions 14, 16 and 18 are sufficiently strong and only semi-flexible, so that they may serve as anchor points for resistance bands, e.g. elastic or rubber bands, as shown in FIGS. 10A, 10B, 11, and 13A, 13B, 13C, and discussed with regard to the corresponding methods. Other known devices do not permit such anchoring on the device of a resistance band.

More specifically, with regard to the advantages of orthopaedic gripping device 10, and with reference to FIGS. 7A through 14, the following is a description of some of the preferred and alternative methods available by which device 10 may be used, depending upon the particular therapeutic goal, which goal varies with the type of injury or weakness being treated, or which the user is attempting to prevent.

When it is desired to use temperature therapy in addition to the movement therapy, it is recommended to warm device 10 by running hot tap water into a bowl, immersing the therapeutic device 10 for 5 to 8 minutes, thereafter removing and drying the device using a towel or hand-held blower. It is important that device 10 not be heated in a microwave oven, as such could present a burn hazard due to overheating.

If it is preferred by the therapist to have the patient use cold therapy, orthopaedic gripping device 10 can be simply placed in a freezer or refrigerator for about at least 15 minutes prior to use.

For simplicity of discussion and illustration, the examples of use described below and shown in FIGS. 7A through 14 all refer to the user's (patient's) right hand, generally designated H, with the digits being referenced as T for the thumb, and F1, F2, F3, and F4 designating the fingers of hand H, F1 being the index finger, and F2 and F3 being the middle and "ring" fingers, respectively, and F4 being the little finger of hand H. As previously mentioned, the discussion herein regarding use of device 10 applies equally to use in a left hand, with positional adjustments made accordingly. Mostly commonly, device 10 will be positioned in the palm of hand H with the larger end 22 of body 12 directed toward finger F4, and with the smaller end 20 of body 12 directed toward the user's thumb T.

So disposed, extension, or extrusion 14 is positioned between fingers F1 and F2, extrusion 16 is between fingers F2 and F3, and extrusion 18 is between fingers F3 and F4. This positioning is seen most clearly in FIGS. 11 and 12, but is illustrated in several of the other figures as well. With many of the exercises shown and described, it is conceivable that in the case of certain specific conditions, or for the aid of specific users, the therapist may recommend inverting the position of body 12, end to end in the user's palm. However, ordinarily, the described position is preferred.

Figure 7A:
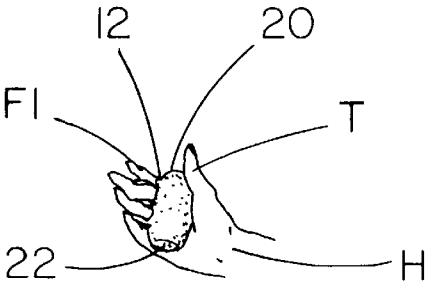
FIGS. 7A and 7B illustrate one method of use of the device shown on FIG. 1, the method being referred to herein as the "full hand grip".
Figure 7B:
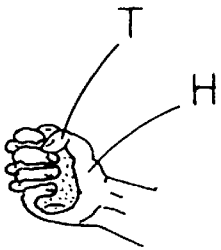

More specifically, with reference to FIGS. 7A and 7B, there is shown the "full hand grip" method of therapeutic use of orthopaedic grip 10. This method strengthens flexion of the long fingers and offers extrinsic strengthening as well. Utilization of the full-hand grip method permits the user to isolate multiple groups: the flexor digitorum superficialis (FDS), flexor digitorum profundus (FDP), the long thumb flexor, flexor pollices longus (FPL) are strengthened by positioning device 10 in the hand through the abductor pollices and flexor pollices.

In performing the full hand grip exercise method, orthopaedic gripping device 10 is held as previously described and as shown in FIGS. 7A and 7B so that body 12 is in the palm of hand H with larger end 22 disposed inwardly of finger F4, and with extrusions 14, 16, 18 between the fingers as described. Hand H is repeatedly squeezed firmly and then released slowly as often as may be prescribed to have the described effect. Conceivably, it may be that a patient user, due to weakness or injury, may be incapable of doing the minimum number of prescribed repetitions. In that instance, the patient would then be encouraged to perform as many repetitions as possible, and to gradually increase to the preferred minimum as hand and/or arm strength and function improve. This may be the case with any of the therapeutic methods described herein.

The above-described full hand grip exercise and the one described hereafter both include multiple tendon and muscle groups. Flexion groups and tendons, both intrinsic and extrinsic, are isolated in a strengthening function, thus causing positive response of strengthening; i.e., the effects of the various exercises "cross over" from one exercise to another and permit overall enhanced effects. It is to be understood that for purposes of this document "intrinsic" and "extrinsic" are used in the conventional manner, "intrinsic" meaning the interior of the muscle or nerve under discussion, and "extrinsic" meaning exterior or outside of the given muscle or nerve.

Figure 8A:
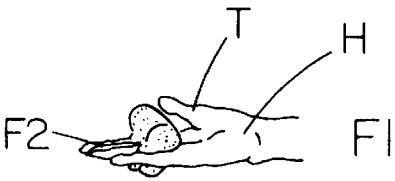
FIGS. 8A, 8B and 8C illustrate a second method of use of the device of FIG. 1, the technique shown being referred to herein as the "finger to palm roll".
Figure 8B:
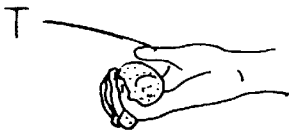
Figure 8C:
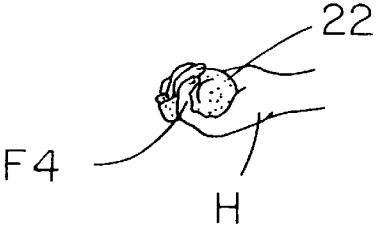

FIGS. 8A, 8B and 8C illustrate the "finger to palm roll" exercise method. This method duplicates the effect on substantially all the same muscle and tendon groups as in the full hand grip method, with the exception of the effect on the thumb. The finger to palm roll facilitates flexion tendon gliding, a necessary motion required to treat most diagnoses of repetitive motion disorders in order to prevent scarring of the tissue interior of the hand.

To perform the finger to palm roll the user positions device 10 as described previously for the full hand grip method, with extrusions 14, 16 and 18 protruding between the fingers, toward the back of the hand, as illustrated in FIG. 8A. Then, fingers F1 through F4 are all curled inwardly, as shown in FIG. 8B and continually curled up to and including the position shown in FIG. 8C, as far inwardly as possible. In other words, beginning at the fingertips, the fingers are curled inwardly, squeezing body 12 of device 10, as body 12 is rolled along the planar side of the fingers and into the palm of hand H.

The next four exercises, as illustrated in FIGS. 8–12, show the use of a resistance band 24 coupled with the design of positioning and resistance which allows the user to isolate the interosseous muscle, thereby causing strengthening of the palmer adductors (PADS). Similarly, the opposite exercise isolates the interosseous muscle, thereby strengthening dorsal adductors (DADS). Isolating these muscles promotes tendon gliding.

Figure 9:
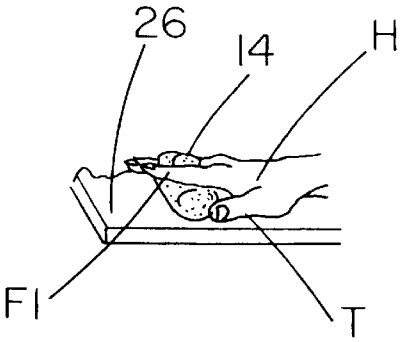
FIG. 9 illustrates a third method of use of the device of FIG. 1, the method being discussed herein as "finger presses".

FIG. 9 illustrates the "finger press" method of therapeutic hand treatment performed with device 10. In this exercise body 12 of device 10 is placed with the outer side wall opposite finger extensions 14, 16, 18 resting on or braced against a table top or other firm work top of surface 26. The extensions protrude upwardly and are disposed between the user's outstretched fingers, with the inner surface of the fingers resting on body 12 between the spaced apart extensions, and with the palm of hand H directed downwardly toward surface 26.

To execute the finger press exercise, the fingers are squeezed or pressed toward one another, transversely in relation to the longitudinal axis of the hand, so as to contact and push against corresponding extensions adjacent to each finger F1–F4. The patient is instructed to use as much pressure as possible in pushing on the extrusion. All fingers may be pressed at one time, or, if preferred in certain therapeutic situations only two preselected fingers may be so exercised.

Figure 10B:
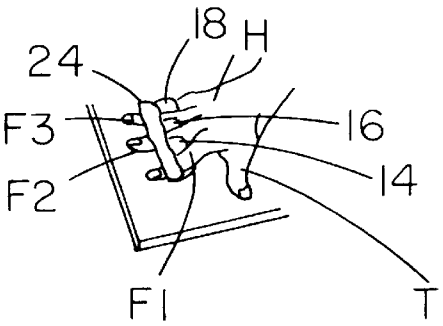
FIGS. 10A and 10B show a fourth method of use of the device of FIG. 1, the method being referred to herein as "finger spread and resistance".
Figure 10A:
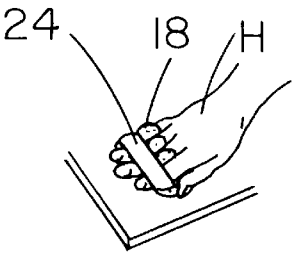

In the "finger spread and resistance" exercise illustrated in FIGS. 10A and 10B, with the hand in the full hand grip position relative to device 10, but with the fingers extended as shown, resistance band 24 (such as a very strong rubber band) is placed around the ends of the fingers, as shown in FIG. 10B, outwardly of the points of contact of the fingers with the corresponding extensions. The user then squeezes the fingers inwardly against corresponding adjacent extrusions 14, 16 and 18, and then alternatively, outwardly against the ends of the band.

Figure 11:
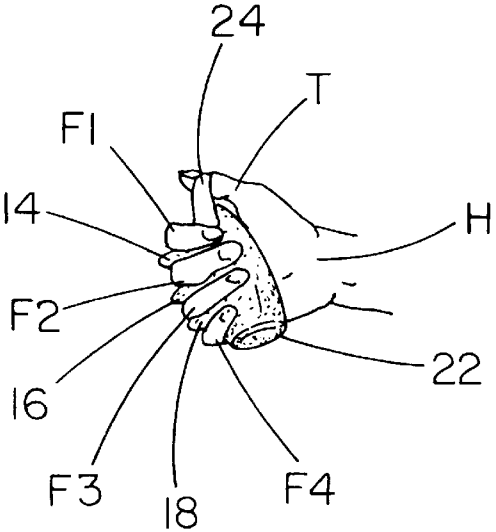
FIG. 11 illustrates a fifth method of use of the device of FIG. 1, the method being referred to herein as a "thumb extension".

The "thumb extension" exercise shown in FIG. 11 is preferably offered to the patient user with a band placed under the grip (over the extensions and held between the inside of the fingers against body 12 of grip 10) and outwardly, over the thumb as shown. Gradual extension of thumb T isolates the patient's extensor pollices longus tendon and extensor pollices brevis tendon. Return position flexing of the thumb permits isolation of the flexor pollices longus (FPL) muscle. Again, the unique gripping device design provides multiple functions, offering the isolation of tendon and muscle groups together in one exercise, with the same device.

Figure 12:
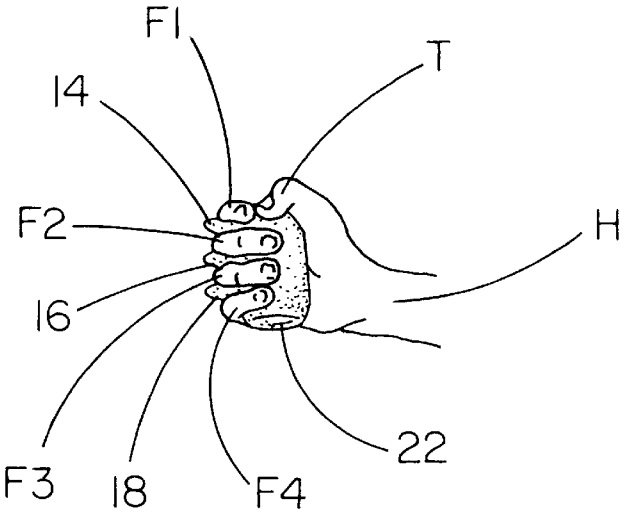
FIG. 12 shows a sixth method of use of the device of FIG. 1, the method being referred to herein as the "thumb flex".

FIG. 12 illustrates a "thumb flexing" exercise with grip device 10 held in the full hand grip position previously described, but with thumb T depressing into one end, preferably the narrow end 20 of body 12, rather than having the thumb curl around end 20 opposite to finger F1. After pressing for a preselected time, the thumb is then slowly released. This action is repeated as often as the therapist or other health professional recommends to achieve the desired therapeutic results.

Figure 13A:
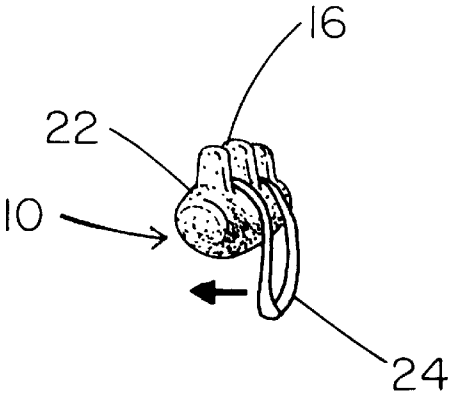
FIGS. 13A, 13B and 13C illustrate a seventh method of use of the device of FIG. 1, the method being referred to herein as "finger extension".
Figure 13B:
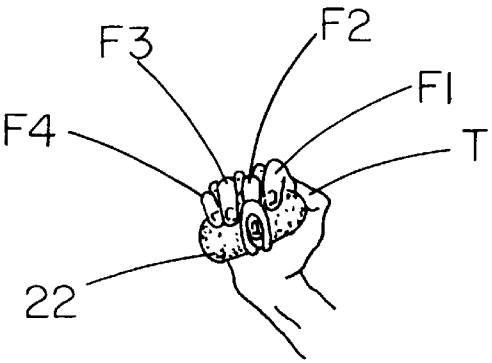
Figure 13C:
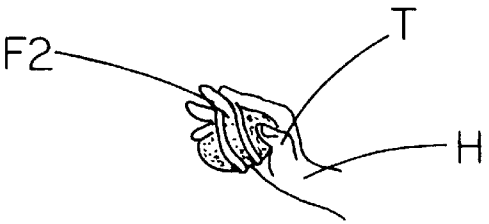

The next example of a therapeutic exercise to be performed with device 10 is illustrated in FIGS. 13A, 13B and 13C, and is referred to as the "finger extension" exercise and includes the use of resistance band 24 which is placed around and anchored by a preselected one of the three extrusions 14, 16 and 18, whichever extrusion is closest to the finger to be treated. In the example shown in FIG. 13A, band 24 is placed around extension 16 in order to exercise finger F2. Band 24 is brought underneath body 12 of device 10 and then over the end of the user's corresponding finger to be exercised. Generally, a position with band 24 disposed at a point approximately over the joint just proximal of the fingernail is appropriate.

For treatment by the finger extension method, the finger is repeatedly slowly extended into a fully open position (shown in FIG. 13C) and then gradually brought back down to a closed position, curled around body 12, as shown in FIG. 13B. A single finger may be exercised in this manner, as illustrated in the figures, or the band may be placed around the ends of two or more fingers if necessary or desired. This intrinsic exercise isolates the long finger extensors, extensor digitorum communis (EDC). Additional intrinsic muscles which are strengthened are the lumbrical muscles (smaller muscles which extend to the interphalangeal (IP) joints), the common extenders for the EDC.

The further sample exercise is illustrated schematically in FIG. 14 and is referred to as the "fingertip pinch". When all fingers F1–F4 are used the tips of the fingers are placed in adjacent to one another in longitudinal alignment along body 12 and the tip of thumb T is disposed against body 12 at a point opposite the line of the fingers.

In execution of this exercise body 12 of orthopedic gripping device 10 is repeatedly pressed or pinched between the fingertips and the tip of thumb T. This action is performed repeatedly, either with all fingers simultaneously, or alternatively, with individual fingers and the thumb, as however may be prescribed, given the specific injury or weakness being treated. This exercise effects positively the FPL, FPB (flexor pollicis brevis), (intrinsic) and FDS, FDP, (extrinsic) muscles when all fingers are used.

As has been seen, new device 10 is unique in its ability to allow the user to exercise intrinsic and extrinsic structures, because of shape and positioning of the design and extrusions. In all of the above exercise examples it is preferred that the prescribed movements using the device be performed by the patient user repeatedly, for a gradually increasing number of repetitions per treatment session, as the condition being treated improves and in keeping with the treating therapist's recommendations. This is not to say, however, that some improvement in condition may not be seen even when device 10 is not used as recommended.

Although primarily a therapeutic hand treatment device, as has been shown, and as will be understood by one skilled in the art, orthopaedic gripping device 10, by its unique structure permits selective isolation of many more muscle and tendon groups than other, simpler devices. Although there other hand strengtheners are known and used in therapy, as well as by athletes and the general public for pure strengthening, the presently described device 10 is differentiated because of the isometric, isotonic and specific muscle and tendon action isolation and strengthening which grip 10 enables the patient user to achieve, particularly with professional therapeutic guidance. The described isometric and isotonic nature of the therapeutic effect of orthopaedic gripping device 10 provides it with multiple use utility which is unique among therapeutic gripping devices.

In view of the foregoing, it will be seen that the several objects of the invention are achieved and other advantages are attained.

Although the foregoing includes a description of the best mode contemplated for carrying out the invention, various modifications are conceivable.

As various modifications could be made in the constructions and methods herein described and illustrated without departing from the scope of the invention, it is intended that all matter contained in the foregoing description or shown in the accompanying drawings shall be interpreted as illustrative rather than limiting.

What is claimed is:

1. An orthopaedic gripping device to isotonicly and isometricly therapeutically treat the user's hand, the device comprising a generally oblong body having a circular transverse section, the body having a first end and a second end and extending in a smooth curve continuously between the first end and the second end, and three substantially flat, firm extensions which are integrally formed on and extend outwardly along the length of the body, spacedly and parallel in relation to each other, said extensions being of sufficient length to protrude outwardly between the user's fingers when the body of the device is cradled in the palm of the user's hand and the three extensions are alternatingly disposed between adjacent fingers of the user, wherein the device is formed of a pliable, resilient semi-deformable material which will return to its original shape after having been so deformed, the material of the device having a durameter hardness reading of approximately 25 to approximately 65 on an 00 scale.

2. The device of claim 1, wherein the durameter reading firmness of the device is approximately 25 to approximately 30.

3. The device of claim 1, wherein the durameter reading firmness of the device is approximately 40 to approximately 45.

4. The device of claim 1, wherein the durameter reading firmness of the device is approximately 50 to approximately 65.

5. The device of claim 1, wherein the device is provided with a color coded to the durameter firmness of the material of which the device is formed.

6. The device of claim 1, wherein the body portion has a length of approximately three and three quarters inches.

7. The device of claim 1, wherein the body of the device has a diameter at the thickest point along the length of the body of approximately two inches.

8. The device of claim 1, wherein the first end has a diameter larger than the diameter of the second end.

9. The device of claim 1, wherein the plurality of extensions comprises three such extensions.

10. The device of claim 1, wherein each of the plurality of extensions extends approximately one and one eighth inches from the point of its intersection with the body portion of the device.

11. The device of claim 1, wherein each of the plurality of extensions has a width of approximately one inch.

12. The device of claim 1, wherein each of the plurality of extensions has a thickness of approximately one quarter inch.

13. The device of claim 1, wherein the plurality of extensions are positioned on the body, in spaced, longitudinal relationship from one another, spaced apart by approximately seven eighths inch and inwardly from the corresponding first or second end of the body portion by approximately five eighths inch.

14. The device of claim 1, wherein the entire device is formed as an unitary molded piece.

15. A method of therapeutically treating a user's hand wherein the method comprises:

providing a resilient device having a generally oblong body being a molded unitary piece with a circular transverse section, the body having a first end and a second end and extending continuously between the first end and the second end, and three substantially flat, firm extensions which intersect and extend outwardly along the length of the body, spacedly from one another and parallel in relation to each other, placing the device in the user's hand with the plurality of extensions separating and protruding outwardly between the user's fingers with the body portion of the device being cradled in the palm of the user's hand; and moving a preselected portion of the user's hand in a prescribed manner in relation to the device in order to therapeutically isometricly and isotonicly treat a particular predetermined finger or other portion of the hand.

16. The method of claim 15, wherein the first end of the device has a diameter larger than a diameter of the second end of the device, and further comprising gripping the device so that the smaller second end is gripped between the user's thumb and the forefinger and the larger first end is gripped by the user's smallest finger against the palm of the hand and the extensions are between the fingers, and repeatedly and slowly squeezing and then releasing the body of the device in the hand.

17. The method of claim 15, and further comprising squeezing the fingers together, medially toward one another, and against an extension between adjacent fingers, as the body portion of the device is rolled into the user's palm, and then unrolling the body portion outwardly from the palm toward the fingers and repeating the above steps a preselected number of times.

18. A method of therapeutically treating a user's hand wherein the method comprises:

providing a device having a generally oblong body with a circular cross section, the body having a first end and a second end and extending continuously between the first end and the second end, and a plurality of extensions which intersect and extend outwardly from the body, spacedly from one another and parallel in relation to each other, placing the device in the user's hand with the plurality of extensions protruding outwardly between the user's fingers and the body portion of the device being cradled in the palm of the user's hand; and moving a preselected portion of the user's hand in relation to the device in order to therapeutically treat a particular predetermined finger or other portion of the hand, and further comprising bracing the body portion of the device against a tabletop or the user's lap with the extensions between the fingers, and firmly squeezing the user's fingers together, medially, toward, one another to a point of maximum pressure on the extensions, gently releasing the pressure and then repeating the above steps a preselected number of times.

19. A method of therapeutically treating a user's hand wherein the method comprises:

providing a device having a generally oblong body with a circular cross section, the body having a first end and a second end and extending continuously between the first end and the second end, and a plurality of extensions which intersect and extend outwardly from the body, spacedly from one another and parallel in relation to each other, placing the device in the user's hand with the plurality of extensions protruding outwardly between the user's fingers and the body portion of the device being cradled in the palm of the user's hand; and moving a preselected portion of the user's hand in relation to the device in order to therapeutically treat a particular predetermined finger or other portion of the hand, and further comprising placing the body portion of the device against a table top or other surface, with the finger outstretched and the extensions extending upwardly between the fingers, placing a resistance band around the ends of the fingers from the outermost finger to the innermost finger and squeezing the fingers first inwardly against the extensions and then outwardly against the resistance band, and repeating the above steps a preselected number of times.

20. A method of therapeutically treating a user's hand wherein the method comprises:

providing a device having a generally oblong body with a circular cross section, the body having a first end and a second end and extending continuously between the first end and the second end, and a plurality of extensions which intersect and extend outwardly from the body, spacedly from one another and parallel in relation to each other, placing the device in the user's hand with the plurality of extensions protruding outwardly between the user's fingers and the body portion of the device being cradled in the palm of the user's hand; and moving a preselected portion of the user's hand in relation to the device in order to therapeutically treat a particular predetermined finger or other portion of the hand, and further comprising placing a resistance band around the extensions between the body of a portion of the device and the user's fingers, placing one end of the resistance band over the user's thumb and repeatedly extending the thumb upwardly and inwardly, and repeating the above steps a preselected number of times.

21. The method of claim 15, and further comprising repeatedly pressing a user's thumb into one of the first end and the second end of the body portion of the device, whichever is positioned between the user's index finger and thumb, and slowly releasing the thumb, and repeating the above steps a preselected number of times.

22. A method of therapeutically treating a user's hand wherein the method comprises:

providing a device having a generally oblong body with a circular cross section, the body having a first end and a second end and extending continuously between the first end and the second end, and a plurality of extensions which intersect and extend outwardly from the body, spacedly from one another and parallel in relation to each other, placing the device in the user's hand with the plurality of extensions protruding outwardly between the user's fingers and the body portion of the device being cradled in the palm of the user's hand; and moving a preselected portion of the user's hand in relation to the device in order to therapeutically treat a particular predetermined finger or other portion of the hand, and further comprising placing a resistance band around at least a preselected one of the plurality of extensions, causing the resistance band to press around the body portion of the device and over the end of one of the user's fingers, extending the finger to a fully open position and then relaxing the finger slowly, and inwardly to a closed position, curled around the body of the device and repeating the above steps a predetermined number of times.

23. The method of claim 15, and further comprising positioning the body of the device between the tip of the user's thumb and the tips of the user's fingers, and repeatedly squeezing and releasing the body of the device between the fingertips and the thumb for a predetermined number of times.

24. The method of claim 15, and further comprising providing a device of increasing density at subsequent exercise sessions, so that as the user's hand increases in strength a more firm device is used for the therapeutic method to provide the user with gradually increasing resistance over the course of therapy.

* * * * *